United States Patent [19]

Voorheis

[11] Patent Number: 4,690,639

[45] Date of Patent: Sep. 1, 1987

[54] CONSTANT PRESSURE VARIABLE ORIFICE BURNER NOZZLE ASSEMBLY

[75] Inventor: James T. Voorheis, Essex Fells, N.J.

[73] Assignee: Voorheis Industries, Inc., Fairfield, N.J.

[21] Appl. No.: 937,435

[22] Filed: Dec. 3, 1986

Related U.S. Application Data

[63] Continuation of Ser. No. 733,557, May 13, 1985, abandoned, which is a continuation-in-part of Ser. No. 585,087, Mar. 1, 1984, abandoned.

[51] Int. Cl.[4] ..... F27B 7/34

[52] U.S. Cl. ..... 432/105; 110/226; 110/246; 239/562; 431/181; 432/108

[58] Field of Search ..... 239/413, 419.3, 456, 239/462, 459, 552, 456, 558, 553.3, 553.5; 431/12, 181, 284; 432/222, 103, 105, 106, 107, 108, 109, 110; 110/246, 226

[56] References Cited

U.S. PATENT DOCUMENTS

| | | | |
|---|---|---|---|
| 733,693 | 4/1903 | Blandon | 431/410.3 |
| 775,156 | 11/1904 | Ullmann | 239/456 |
| 881,842 | 3/1908 | Bender | 239/556 X |
| 1,024,596 | 4/1912 | Oakley | 431/189 |
| 1,094,124 | 4/1914 | Coen | 239/456 X |
| 1,561,809 | 11/1925 | Valerius | 239/460 |
| 1,584,546 | 5/1926 | Jones | 431/187 |
| 1,696,196 | 12/1928 | Gray | 239/456 |
| 1,706,750 | 3/1929 | Rigby | 432/105 |
| 1,731,090 | 10/1929 | Beeby . | |
| 1,753,613 | 4/1930 | McCoy . | |
| 1,774,953 | 9/1930 | Titmas et al. . | |
| 1,781,236 | 11/1930 | Lilge | 431/352 |
| 1,788,495 | 1/1931 | Sheppard . | |
| 1,844,151 | 2/1932 | Friedman . | |
| 1,879,916 | 9/1932 | Bagley . | |
| 1,903,100 | 3/1933 | Esterling . | |
| 2,003,827 | 6/1935 | Esterling . | |
| 2,185,886 | 1/1940 | Caldwell . | |
| 2,251,192 | 7/1941 | Krumsiek et al. | 239/558 X |
| 2,290,785 | 7/1942 | Turpin . | |
| 2,301,017 | 11/1942 | Cherry | 432/108 X |
| 2,303,648 | 12/1942 | Lemster et al. | 239/419.3 |

(List continued on next page.)

FOREIGN PATENT DOCUMENTS

| | | | |
|---|---|---|---|
| 786155 | of 1935 | France | 239/562 |
| 48207 | 7/1982 | Japan | 431/350 |
| 161411 | 10/1982 | Japan | 431/147 |
| WO81/01668 | 6/1981 | PCT Int'l Appl. | 239/562 |
| 8573 | of 1909 | United Kingdom | 239/562 |
| 2541 | of 1913 | United Kingdom | 239/456 |
| 1441750 | 7/1976 | United Kingdom | 431/284 |
| 663967 | 5/1979 | U.S.S.R. | 239/562 |
| 47905 | 5/1979 | U.S.S.R. | 239/562 |

*Primary Examiner*—Samuel Scott
*Assistant Examiner*—Allen J. Flanigan
*Attorney, Agent, or Firm*—Popper, Bobis & Jackson

[57] ABSTRACT

In a burner gun of the type including a conduit having a gas inlet supplied with a gas and an outlet, a burner nozzle assembly includes an outlet plate secured to the outlet of the gas conduit and having a plurality of circumferentially arranged cylindrical orifices extending therethrough, the outer surface of outlet plate including a circular central portion surrounded by the orifices and operative as a bluff body, whereby positive flame retention in the range of 5 PSI to 50 PSI is obtained; a hollow cylinder having a plurality of plugs secured to an end face thereof and axially movable with respect to the orifices to vary the openings thereof so as to provide a constant velocity gas exiting through the orifices; and a piston rod connected to the cylinder and externally controlled to slideably move cylinder and thereby control movement of the orifice plugs with respect to the orifices so as to vary the openings of the latter. In this first embodiment, the hollow cylinder does not impede the flow of natural gas. In a second embodiment, the orifices are arranged in at least one linear row parallel to the material to be burned to reduce the residual sulfide level in a lime sludge kiln to less than 20 ppm. In a third embodiment for use with a radial duct burner, the orifices are arranged in the conduit for radial emission of the natural gas and a mechanism for translating reciprocable motion to rotational motion to reciprocable motion is provided such that a plurality of orifice plugs in the form of balls are reciprocably movable with respect to the orifices in the radial direction.

13 Claims, 13 Drawing Figures

U.S. PATENT DOCUMENTS

| | | | |
|---|---|---|---|
| 2,314,836 | 3/1943 | Seil | 432/110 X |
| 2,526,748 | 10/1950 | Hill . | |
| 2,630,324 | 3/1953 | Lay | 239/562 X |
| 2,645,383 | 7/1953 | Miller | 239/562 X |
| 2,654,592 | 10/1953 | Harris | 432/109 |
| 2,978,188 | 4/1961 | Fredrikson | 239/562 |
| 3,102,446 | 5/1965 | Kaminski | 239/456 |
| 3,243,127 | 3/1966 | Watson | 239/562 |
| 3,771,944 | 11/1973 | Hovis et al. | 431/284 |
| 4,265,377 | 5/1981 | Moen | 239/562 X |
| 4,373,909 | 2/1983 | Petit et al. | 239/553.5 X |
| 4,462,793 | 7/1984 | Maeda et al. | 432/106 X |

CONSTANT PRESSURE VARIABLE ORIFICE BURNER NOZZLE ASSEMBLY

REFERENCE TO RELATED APPLICATION

This application is a continuation of application Ser. No. 733,557, filed May 13, 1985, now abandoned, which is a Continuation-In-Part Application of U.S. pWPatent application Ser. No. 06/585,087, filed Mar. 1, 1984, now abandoned, to the same applicant and entitled Constant Pressure-Variable Orifice Burner Nozzle Assembly.

BACKGROUND OF THE INVENTION

1. Field of the Invention

This invention relates generally to burners for combustible material and, more particularly, is directed to a burner nozzle assembly for a gas burner.

2. Description of the Prior Art

With burner assemblies, it is desirable to provide accurate adjustment of the amount of fluid utilized in the burner assembly. To this end, it is known to adjust the oil or gas flow in an oil or gas burner by means of a nozzle having a plurality of orifice plugs which are axially movable with respect to the opening of the nozzle. Examples of such arrangements are shown and disclosed in U.S. Pat. Nos. 1,696,196; 1,781,236 and 3,771,944; and Japanese Patent Publication Nos. 57-105611 and 57-161411. Outside of the burner art, see U.S. Pat. Nos. 775,156 and 1,561,809.

Further, U.S. Pat. No. 3,684,192 discloses a single nozzle, outside of the burner art, which provides constant pressure, variable flow, regardless of the pressure from the source.

U.S. Pat. No. 4,285,664 to the same inventor herein discloses a burner for a plurality of fluid streams and is generally of the type to which the present invention is directed. With the burner of this latter apparatus, however, there is no adjustment of the gas pressure or velocity at the outlet side of the burner nozzle. This patent also discloses a bluff body effect which is produced by the flat downstream end of a velocity ring by which a toroidal eddy is produced.

With the above burner patents, for example, that shown in U.S. Pat. No. 1,781,236, where a plurality of curcumferentially arranged orifices are provided along with a plurality of circumferentially arranged orifice plugs which are axially movable toward and away from the respective orifices, a problem occurs with mounting the orifice plugs so as not to interfere with the axial and linear flow of the gas to the orifices, while at the same time, providing for a constant velocity flow of gas from the orifices.

Attention is also drawn to U.S. Pat. Nos. 1,024,596; 1,584,546; 2,978,188; 3,102,446; 3,243,127; British Pat. No. 1,441,750; French Pat. No. 786,155; PCT Publication No. 8101668; and USSR Pat. No. 47,905.

Related to the problem of providing accurate adjustment of the amount of fluid utilized in a burner assembly, in sludge lime kiln stacks, emission requirements call for the total residual sulfides (TRS) to be less than 20 parts per million (PPM). This emission requirement is difficult to achieve with conventional burner assemblies which do not provide accurate adjustment of the amount of fluid utilized in the burner assembly. Such emission requirements can not be met with a burner assembly of the aforementioned type in which the orifices are arranged circumferentially.

Further, with the aforementioned U.S. Patents, the use of conical or frusto-conical shaped orifice plugs results in a relatively slow non-linear response curve for the flow of natural gas. It therefore further becomes difficult to achieve the aforementioned emission requirements.

A further problem occurs with respect to radial duct burners. More particularly, with rotary kilns, such as that shown in U.S. Pat. No. 1,781,236, to control the orifice openings, it is only necessary to axially move the shaft which is connected to the orifice plugs. In a radial duct burner, however, the orifice openings are arranged circumferentially in the radial direction. Thus, mere axial movement of a shaft is not possible for controlling movement of the orifice plugs.

OBJECTS AND SUMMARY OF THE INVENTION

Accordingly, it is an object of this invention to provide a burner nozzle assembly by which the amount of gas emitted from the assembly can be easily and readily controlled without change to the burner upstream pressure, in a rotary kiln or radial duct burner.

It is another object of this invention to provide a burner nozzle assembly by which the velocity of the gas emitted from the assembly can be easily and readily maintained without change to the upstream pressure, in a rotary kiln or radial duct burner.

It is still another object of this invention to provide a burner nozzle assembly which can adjust the gas velocity of the burner nozzle to provide an optimum gas velocity over the entire range of operation by altering the gas supply pressure, in a rotary kiln or radial duct burner.

It is yet another object of this invention to provide a burner nozzle assembly which provides uniformity in gas distribution at the outlet thereof, in a rotary kiln or radial duct burner.

It is a further object of this invention to provide uniformity in gas distribution at the outlet of the burner nozzle assembly by providing a constant gas velocity at the outlet thereof and a bluff body effect, in a rotary kiln or radial duct burner.

It is a still further object of this invention to provide a burner nozzle assembly which provides positive flame retention by means of a bluff body effect with constant upstream gas pressure values in the operating range of 5 PSI to 50 PSI.

It is a yet further object of this invention to provide a burner nozzle assembly which satisfies emission requirements calling for less than 20 ppm of total residual sulfides in sludge lime kiln stacks.

In accordance with an aspect of this invention, in a burner gun for a rotary kiln of the type including conduit means having an inlet and an outlet; and gas inlet means for supplying a gas to the inlet of the conduit means, a burner nozzle assembly includes gas outlet means at the outlet of the conduit means for emitting the gas supplied to the conduit means, the gas outlet means including a plurality of circumferentially arranged cylindrical orifices extending therethrough, and said outer surface including a central portion surrounded by said orifices and operative as bluff body means; a plurality of orifice plug means, each axially adjustable with respect to a respective one of the orifices; and control means for simultaneously adjusting the plurality of orifice plug means with respect to the plurality of orifices to vary the openings of the plurality of orifices so as to provide a constant gas velocity at the outlet of the conduit means, the control means including hollow cylinder means having a first end wall to which the plurality of orifice plug means are secured and piston rod means secured to the cylinder means for simultaneously adjusting the plurality of orifice plug means.

In accordance with a second embodiment of the present invention, the plurality of orifices are arranged in at least one linear row and substantially parallel to the material to be burned at the outlet of the conduit means so as to satisfy emission requirements calling for less than 20 ppm of total residual sulfides in sludge lime kiln stacks.

In accordance with another aspect of this invention, in a burner gun for a radial duct burner of the type including conduit means having an inlet and an outlet; and gas inlet means for supplying a gas to the inlet of the conduit means, a burner nozzle assembly includes gas outlet means for emitting the gas supplied to the conduit means, the gas outlet means including a plurality of orifices at the outlet of the conduit means; a plurality of orifice plug means, each radially adjustable with respect to a respective one of the orifices; and control means for simultaneously adjusting the plurality of orifice plug means with respect to the plurality of orifices to vary the openings of the plurality of orifices so as to provide a constant gas velocity at the outlet of the conduit means.

In accordance with the latter embodiment of the present invention, the control means for radially adjusting the orifice plug means in the radial duct burner includes a linkage assembly that translates reciprocable motion to rotational motion and back to reciprocable motion to adjust the orifice plug means.

The above, and other, objects, features and advantages of the present invention will become readily apparent from the following detailed description thereof which is to be read in connection with the accompanying drawings.

DETAILED DESCRIPTION OF PREFERRED EMBODIMENTS

Figure 1A:
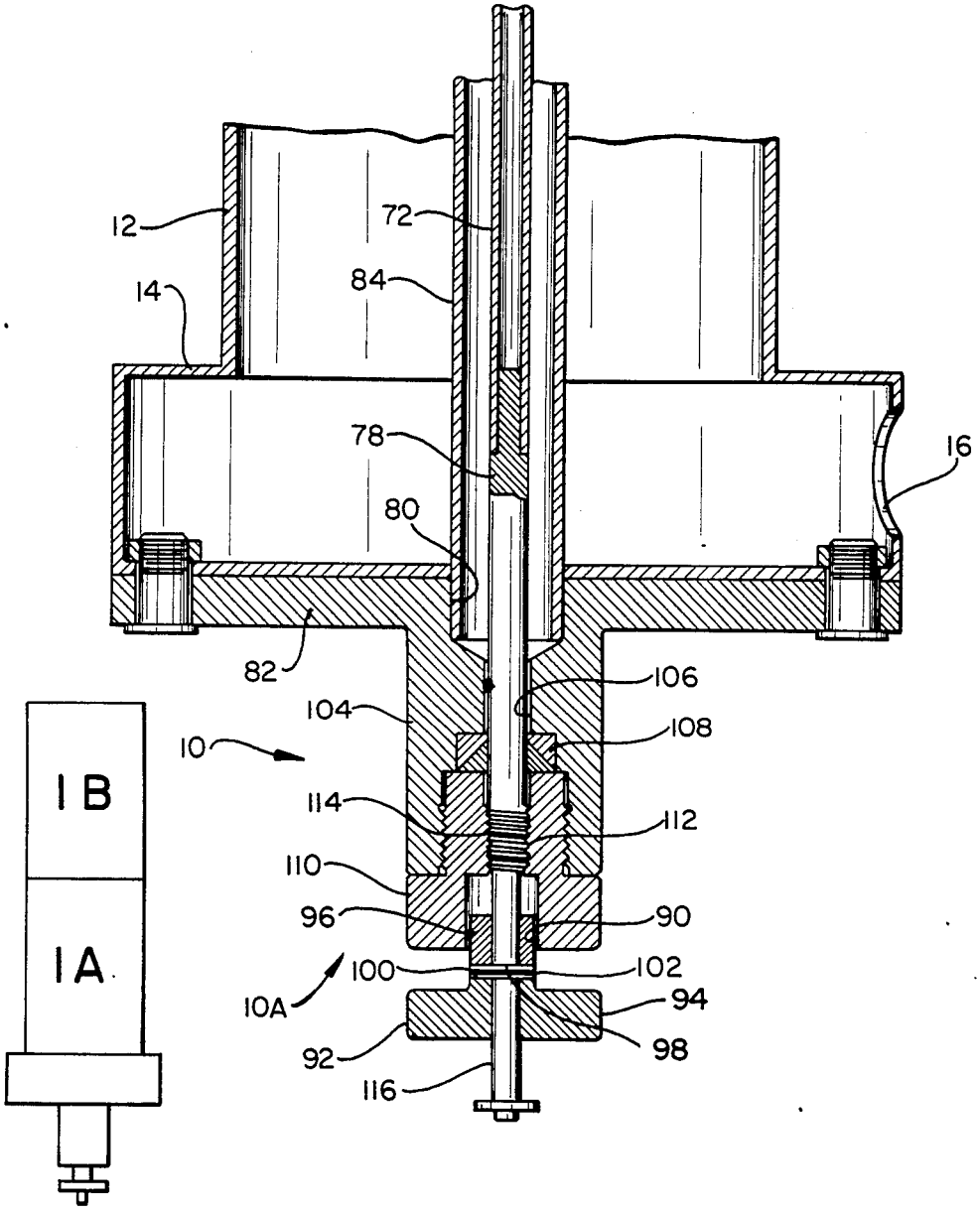
FIG. 1A is a cross-sectional view of the downstream side of a burner gun having a burner nozzle assembly according to one embodiment of the present invention.
Figure 1B:
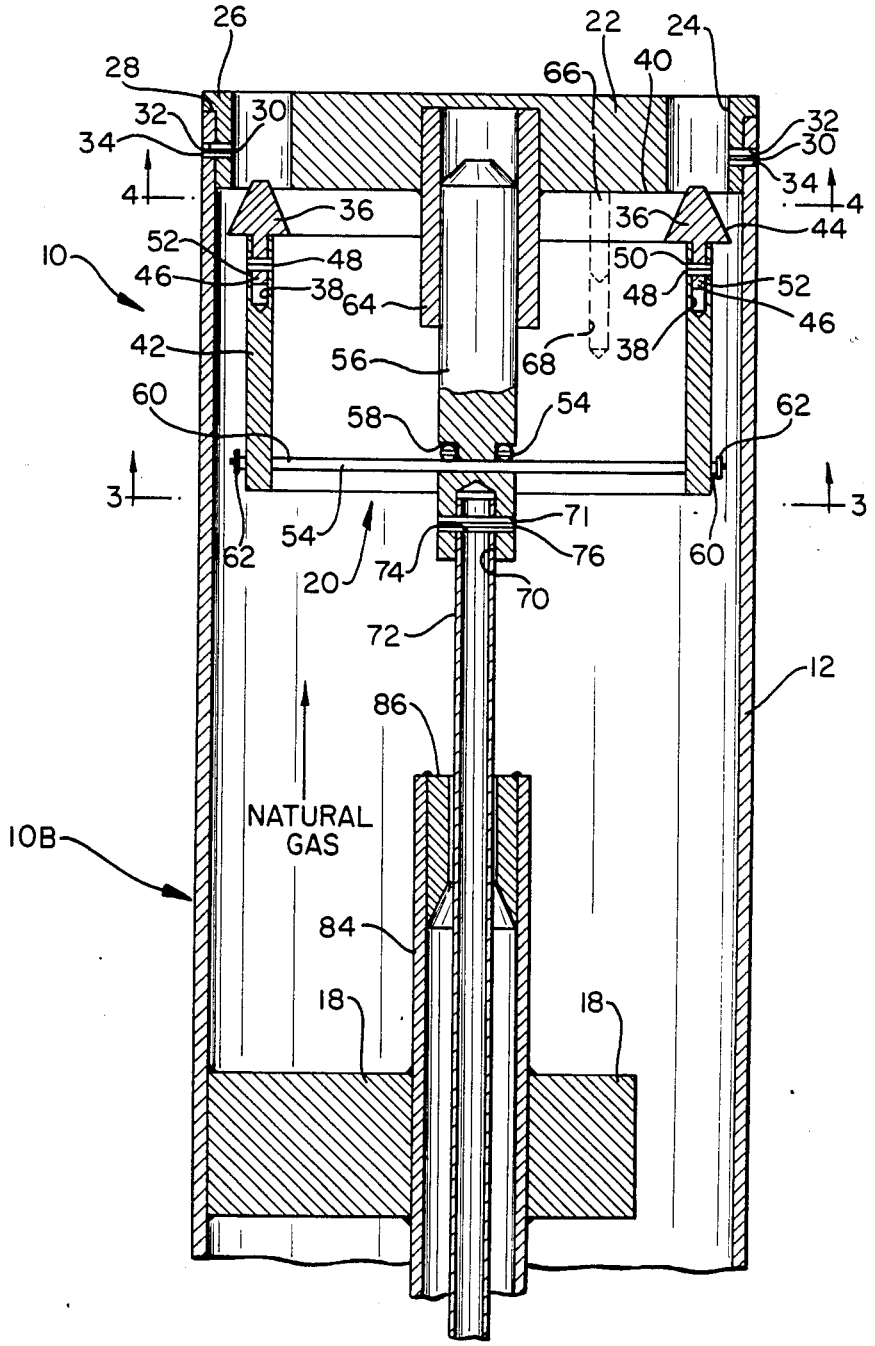
FIG. 1B is a cross-sectional view of the upstream side of the burner gun having the burner nozzle assembly according to one embodiment of the present invention.

Referring to the drawings in detail, and initially to FIGS. 1A and 1B thereof, a burner gun 10 for a rotary kiln according to one embodiment of the present invention is formed with an inlet section 10A shown in FIG. 1A and an outlet section 10B shown in FIG. 1B. Generally, burner gun 10 includes a gas conduit 12 which extends from inlet section 10A to outlet section 10B and by which natural gas is transmitted from the inlet section to the outlet section.

In this regard, inlet section 10A includes a circumferential inlet flange 14 which is in fluid communication with gas conduit 12 and which has an inlet opening 16 through which natural gas is supplied under pressure to gas conduit 12. It is to be appreciated, however, that the configuration of inlet flange 14 and opening 16 may be varied, for example, as shown in U.S. Pat. No. 4,285,664 to the same applicant, the disclosure of the entire patent being incorporated herein by reference.

The natural gas supplied at inlet section 10A under pressure travels through gas conduit 12. In outlet section 10B, the natural gas passes through circumferentially arranged vanes 18. For example, three vanes 18 may be provided which are angularly separated by 120°. The natural gas which passes through vanes 18 is then emitted from the burner gun through a burner nozzle assembly 20 according to the present invention at the outlet side of outlet section 10B.

Figure 4:
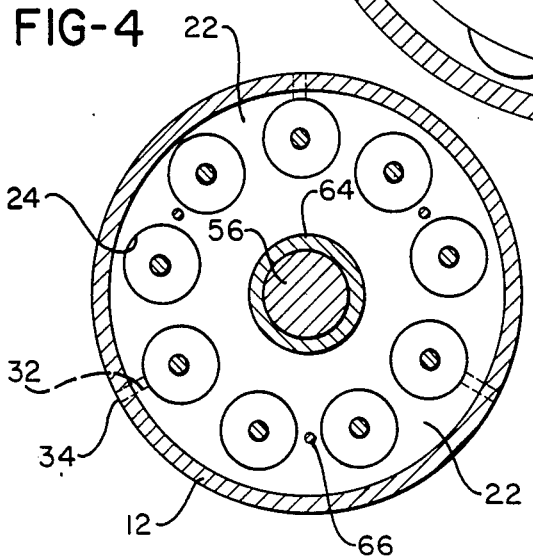
FIG. 4 is a partial cross-sectional, partial plan view of the upstream side of the burner nozzle assembly of FIG. 1B, taken along Line 4—4 thereof.

More particularly, burner nozzle assembly 20 includes an outlet plate 22 having a plurality of circumferentially arranged orifices 24 through which the natural gas is emitted from the burner gun. As shown in FIG. 4, nine equally spaced orifices 24 are provided. However, the number, spacing and size of the orifices may be varied depending upon the particular application. Outlet plate 22 snugly slides within the outlet free end of gas conduit 12 and is provided with a shoulder 26 which abuts against the outlet edge 28 of gas conduit 12. For securing outlet plate 22 to gas conduit 12, a plurality of spring pins 30 are provided for connecting the concentrically arranged overlapping portions of outlet plate 22 and gas conduit 12 through respective aligned apertures 32 and 34 therein.

In accordance with an aspect of this invention, a plurality of orifice plugs 36 corresponding in number to orifices 24 and each associated with a respective orifice 24 are simultaneously controlled for movement in the longitudinal direction of gas conduit 12 for varying the inlet opening dimensions of orifices 24. As a result, the gas velocity, and thereby the gas pressure, of the gas exiting from burner gun 10 can be accurately and readily controlled.

More particularly, orifice plugs 36 are secured within respective end apertures 38 in the end face 40 of an adjusting cylinder 42. As shown in the drawings, each orifice plug 36 is formed in a frusto-conical section 44 which converges toward the smaller diameter end thereof from the larger diameter end thereof which has a dimension at least as great as the opening of the respective orifice 24 and is of a greater diameter than the respective end aperture 38 within which it fits. Each orifice plug 36 further includes a stem 46 which is connected to and extends from the large diameter end of frusto-conical section 44 and has an axis concentric with the axis of frusto-conical section 44. Each stem 46 is inserted within a respective end aperture 38 and is secured therein by a spring pin 48 which extends through respective aligned apertures 50 and 52 in cylinder 42 and stem 46. It is to be noted that, when orifice plug 36 is secured within the respective end aperture 38, the large diameter end face thereof is in abutting or substantially abutting relation with end face 40 of cylinder 42.

Figure 2:
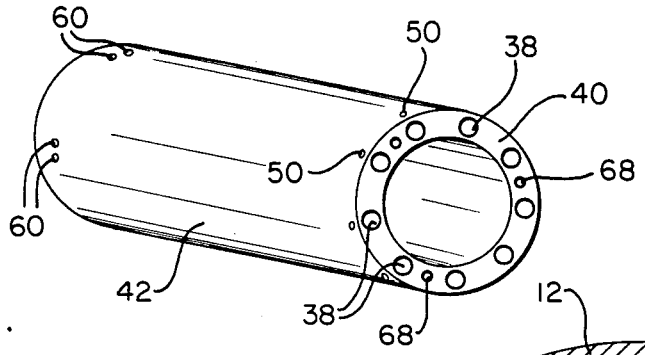
FIG. 2 is a perspective view of the pressure adjusting cylinder in the upstream side of the burner nozzle assembly of FIG. 1B.
Figure 3:
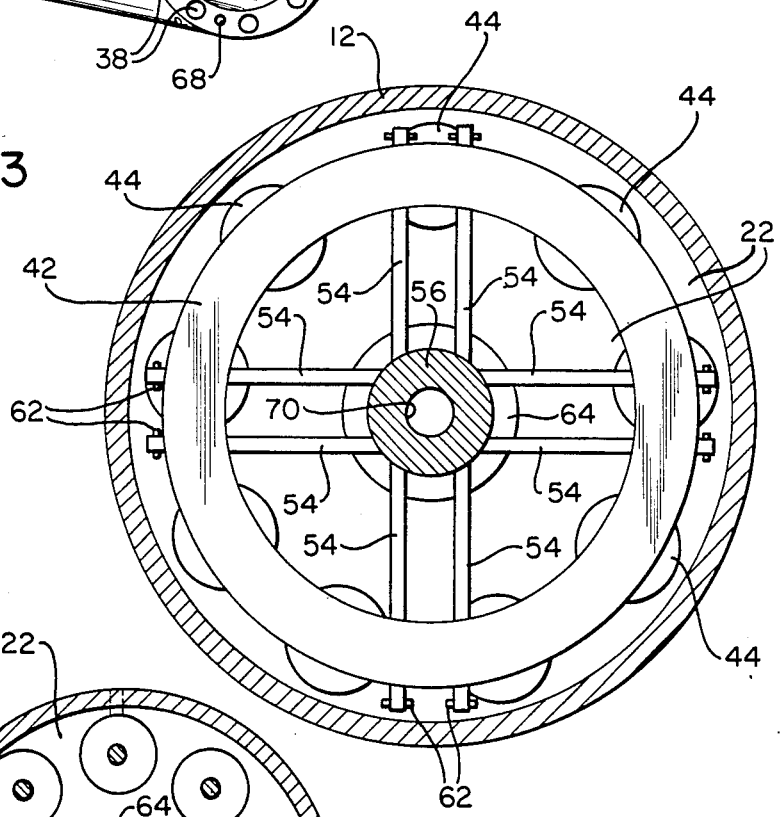
FIG. 3 is a partial cross-sectional, partial plan view of the upstream side of the burner nozzle assembly of FIG. 1B, taken along Line 3—3 thereof.

For axial thrust movement of adjustable cylinder 42 and orifice plugs 36 with respect to outlet plate 22 and orifices 24, two sets of parallel thrust rods 54 are provided, the thrust rods 54 of each set being substantially orthogonal to the thrust rods 54 of the other set. Further, a piston-rod end piece 56 is provided with a circumferential groove 58. Thrust rods 54 of one set, for example, the vertically-arranged set shown in FIGS. 1B and 3, are positioned on opposite sides of end piece 56 within groove 58 and at one end of groove 58, while the other set of horizontally-arranged thrust rods 54 are also positioned on opposite sides of end piece 56 within groove 58 and at the opposite end of groove 58 adjacent the vertically-arranged thrust rods 54. Thrust rods 54 extend through substantially diametrically opposite apertures 60, as shown in FIG. 2, at the end of cylinder 42 opposite end face 40 and are prevented from escaping therefrom by means of spring pins 62 at opposite ends of each thrust rod 54 externally of cylinder 42. It is to be noted that thrust rods 54 are of a sufficiently rigid material such that cylinder 42 is positioned by corresponding positioning of end piece 56.

In this regard, outlet plate 22 has a guide sleeve 64 secured centrally therein, guide sleeve 64 having an internal diameter slightly larger than the external diameter of end piece 56. In this manner end piece 56 is slideably received within guide sleeve 64 for sliding movement therein. It is to be appreciated that guide sleeve 64 thereby serves a two-fold purpose, namely, accurate positioning of orifice plugs 36 with respect to the respective orifices 24 and also enabling sliding movement of adjustable cylinder 42, and thereby orifice plugs 36, with respect to orifices 24 to vary the openings of the latter.

To provide further stable alignment of adjustable cylinder 42 and orifice plugs 36 with respect to orifices 24, outlet plate 22 is provided with dowel pins 66 extending axially therefrom and positioned along the circumference of apertures 24 and positioned therebetween, as shown in FIGS. 1B and 4. End face 40 of cylinder 42 is provided with corresponding apertures 68 for receiving dowel pins 66, as shown in FIGS. 1B and 2, so as to provide accurate alignment of orifice plugs 36 with respect to orifices 24.

It is to be appreciated that, with the arrangement described thus far, orifice plugs 36 are slideably movable in the longitudinal or axial direction with respect to orifices 24 to vary the openings of the latter. In this manner, the pressure and velocity of the gas exiting from the burner gun can be accurately, easily and uniformly controlled.

In addition, it is to be noted that, as the constant pressure, constant velocity gas exits from orifices 24, there is a bluff body effect created by the central portion of the outer end face of outlet plate 22, which provides enhanced mixing and uniformity of the gas. As a result, because of the combination constant pressure-constant velocity gas through a multiplicity of orifices and due to the bluff body effect, there is positive retention of the flame which is usable within the practical range of industrially available gas pressures, that is, from 5 PSI to 50 PSI. Thus, with constant pressure established, gas flow can be varied over an extremely wide range, for example, suitable for drying refractory to instances where a high fire is desired, in a lime sludge kiln.

It is to be noted that there is also somewhat of a bluff body effect from the orifice plugs 36 themselves. However, the main bluff body effect is created by the central portion of the outer end face of outlet plate 22 in combination with the constant pressure, constant velocity gas exiting from orifices 24.

It is to be appreciated that, in each rotary kiln, there is an optimum gas velocity at which Brownian movement and heat radiation are at optimum values. It is therefore desirable to determine the optimum gas velocity during operation of the burner.

In accordance with another aspect of this invention, axially sliding movement of orifice plugs 36 can be externally adjusted during operation. More particularly, the end of end piece 56 opposite that slideably received within guide sleeve 64 is provided with an axially arranged aperture 70 which receives the distal end of a piston rod 72. A spring pin 76 is inserted within aligned apertures 71 and 74 in end piece 56 and piston rod 72 for securing the distal end of piston rod 72 to end piece 56. As shown in FIGS. 1A and 1B, piston rod 72 extends from end piece 56 where it is secured at its opposite end to a regulator body piston 78 which extends through a central aperture 80 of an outer gas gun flange 82 to which circumferential inlet flange 14 is secured. Piston rod 72 is concentrically surrounded with a piston rod extension support tube 84. At outlet section 10B, a bushing 86 is provided at the end of support tube 84 for supporting piston rod 72. The opposite end of support tube 84 is secured to a regulator body 104. In addition, support tube 84 is supported in outlet section 10B by means of the aforementioned circumferentially arranged vanes 18 which are spaced between the inner wall of gas conduit 12 and the outer wall of support tube 84 so as to centrally position support tube 84 and thereby piston 72.

Referring to FIG. 1A, regulator body piston 78 extends from piston rod 72 through aperture 106 of regulator body 104 and is received within an aperture 90 of a knob 92. Knob 92 is formed with a grasping section 94 of a generally cylindrical configuration and with an axial extension 96 projecting centrally therefrom and which contains aperture 90. Both regulator body piston 78 and axial extension 96 contain respective apertures 98 and 100 such that when regulator body 78 is positioned within aperture 90, a spring pin 102 extends within apertures 98 and 100 to lock knob 92 securely onto regulator body 78.

A regulator body 104 is secured to the opposite side of gun flange 82 and includes a central aperture 106 through which regulator body piston 78 extends. Regulator body 104 is formed in a generally cup-shaped configuration and includes a teflon wedge packing 108 inside the cup-like configuration and which is in surrounding relation to regulator body piston 78. A gland 110 is secured within the cup-like configuration of regulator body 104 by means of a screw-threaded arrangement, as shown in FIG. 1A and includes a central axial aperture 112 having screw threads along the length thereof. Regulator body piston 78 extends through aperture 112 and is provided with corresponding screw threads 114.

With this arrangement, when knob 92 is rotated, as a result of screw threads 114 and screw-threaded aperture 112, piston rod 72 is moved axially. As a result, end piece 56 axially slides within guide sleeve 64. As end piece 56 moves in the axial direction thereof, thrust rods 54 control adjustable cylinder 42 and orifice plugs 36 to move in the same axial direction with respect to orifices 24 to adjust the openings thereof. Accordingly, during operation of the burner gun according to the present invention, the gas velocity can be accurately controlled to provide optimum heating characteristics of the burner's flame envelope. It is to be appreciated that knob 92 and the corresponding structure are externally controllable during operation of the apparatus.

An extension 116 secured to knob 92 can be provided for motorized operation in response to an input signal, for example, from a computer programmable controller or the like.

As an example of suitable dimensions that can be used, the distance from the external end face of outlet plate 22 to the end face of support tube 84 is 9 inches, the distance from the end face of support tube 84 to vanes 18 is 3 inches and the distance from the external end face of outlet plate 22 to the internal end face of gun flange 82 is 12 feet 5 inches.

As discussed in the background portion of the present invention, emission requirements call for a total residual sulfide level of less than 20 ppm. However, with the first embodiment of the present invention, it is difficult to reduce the total residual sulfide level to less than 100 ppm in sludge lime kiln stacks, and particularly, sludge lime kilns of the rotary type which contain a level of free standing material at the bottom of the rotary kiln from which lime is derived.

In accordance with the second embodiment of the present invention, a burner assembly is provided having particular utility with sludge lime kilns and which reduces the total residual sulfide level to less than 20 ppm. More particularly, burner gun 210 according to the second embodiment of the present invention is formed with an inlet section (not shown) which is similar to inlet section 10A shown in FIG. 1A, and an outlet section 210B shown in FIG. 5. Generally, burner gun 210 includes a gas conduit 212 which extends from the inlet section to outlet section 210B and by which natural gas is transmitted under pressure from the inlet section to outlet section 210B.

In outlet section 210B, the natural gas passes through circumferentially arranged vanes 218. For example, three vanes 218 may be provided which are angularly separated by 120°. The natural gas which passes through vanes 218 is then emitted from the burner gun through a burner nozzle assembly 220 according to the second embodiment of the present invention at the outlet side of outlet section 210B.

Figure 5:
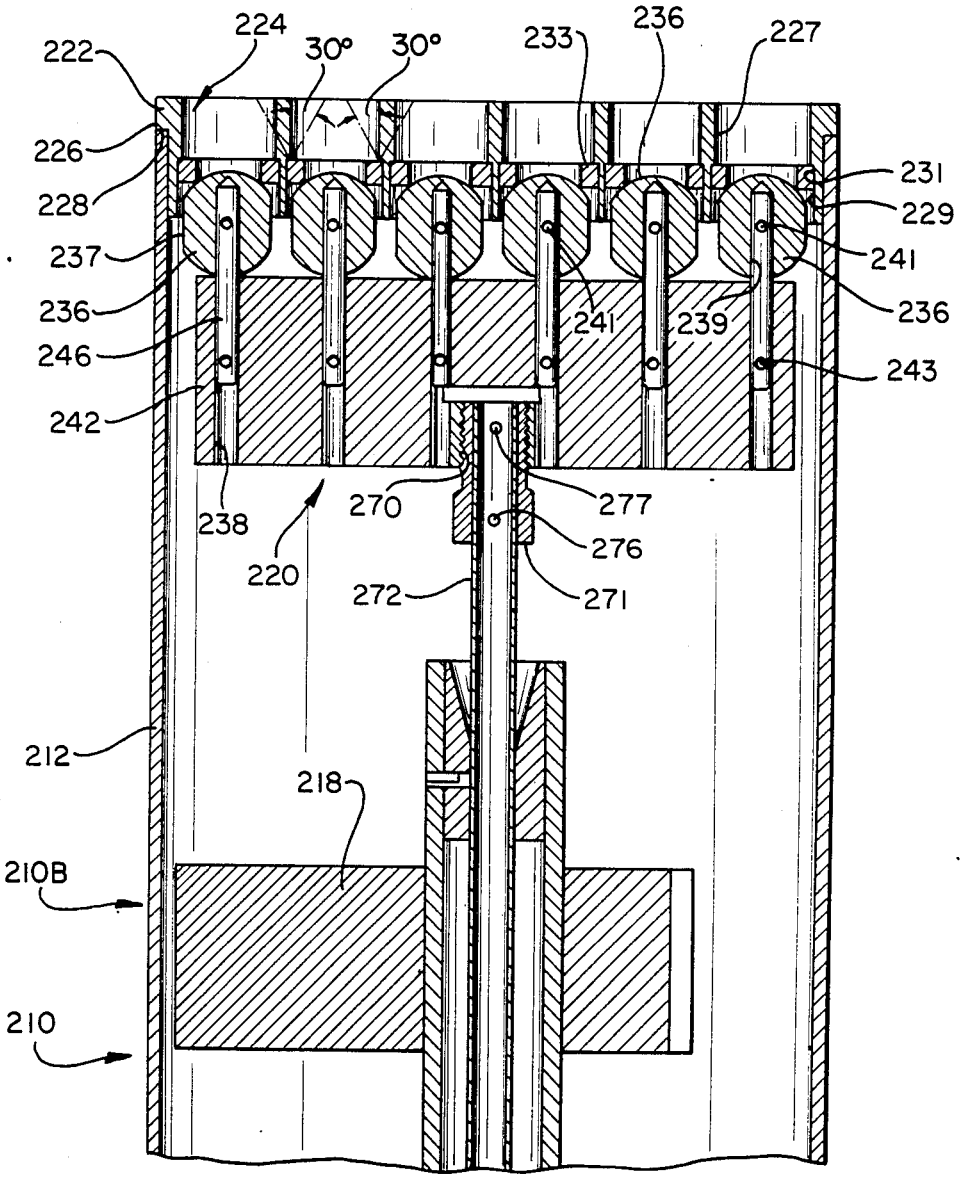
FIG. 5 is a cross-sectional view of the upstream side of a burner gun having a burner nozzle assembly according to another embodiment of the present invention, taken along a substantially 45° angle to the horizontal.
Figure 8:
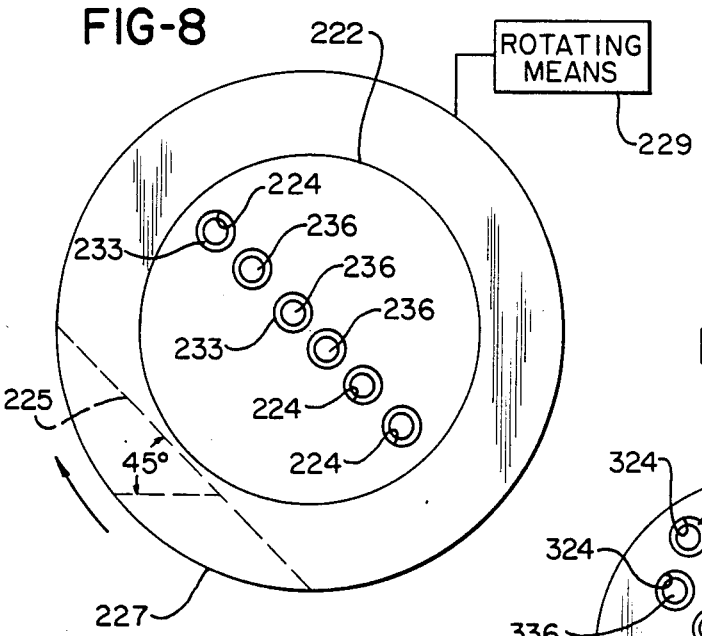
FIG. 8 is an end plan view of the burner gun of FIG. 5.
Figure 9:
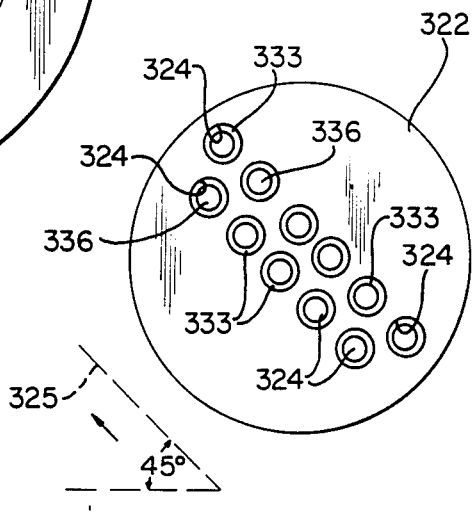
FIG. 9 is an end plan view of a burner gun which is a modification of the burner gun of FIGS. 5–8.

More particularly, burner nozzle assembly 220 includes an outlet plate 222 having a plurality of centrally located and linearly arranged orifices 224 through which the natural gas is emitted from the burner gun. As shown in FIGS. 5 and 8, six equally spaced orifices 224 are provided. However, the number, spacing and size of the orifices may be varied depending upon the particular application. For example, two parallel, linearly arranged rows of orifices 324 may be provided in an outlet plate 322, as shown in FIG. 9 according to a modification of the second embodiment of the present invention. As shown in FIGS. 8 and 9, however, it is important that the orifices 224 and 324 be arranged substantially parallel to any free standing material, shown schematically by dashed lines 225 and 325 in FIGS. 8 and 9, respectively, located in the rotary tube 227 (FIG. 8) of a lime sludge kiln so that the material is burned with a maximum amount of heat due to the parallel arranged orifices. Generally, due to rotation, indicated by the arrows of FIGS. 8 and 9, by conventional rotating means 229, the free standing material assumes a position at a relatively constant, chordal incline of approximately 45°. Thus, the rows of orifices 324 are arranged at this same angle. Such maximum heating of the free standing material from which the lime is developed is achieved such that the total residual sulfide level is less than 20 ppm. In the embodiment of FIGS. 1–4, on the other hand, a total residual sulfide level of less than 100 ppm is not achieved.

Outlet plate 222 snugly slides within the outlet free end of gas conduit 212 and is provided with a shoulder 226 which abuts against the outlet edge 228 of gas conduit 212. The outlet plate 222 may be secured to gas conduit 212 by a friction fit or a plurality of spring pins may be provided similar to that shown in the embodiment of FIG. 1B.

As shown in FIG. 5, each of orifices 224 of outlet plate 222 are provided with an outlet opening section 227 having a first diameter and an inlet opening section 229 having a second, larger diameter. In this regard, each orifice 224 is formed with an inwardly directed shoulder 231 against which an orifice restrictor 233 (or 333 in FIG. 9) is positioned. More particularly, each orifice restrictor 233 is comprised of a ring having an opening which determines the passage diameter through the respective orifice 224. It is to be appreciated that, with this arrangement, outlet plate 222 can be removed and different orifice restrictors 233 can be positioned therein to vary the passage diameter of the orifices 224, depending upon the particular application.

In accordance with still another modification of the embodiment of FIG. 5, the orifices 224 can be formed at an incline to the horizontal in the range of 0° to 30° either downwardly, as shown by the dot-dash lines in FIG. 5, or upwardly as shown by the dashed lines in FIG. 5.

In accordance with the second embodiment of the present invention, a plurality of orifice plugs in the form of orifice balls 236 (or 336 in FIG. 9) corresponding in number to orifices 224 and each associated with a respective orifice 224 are simultaneously controlled for movement in the longitudinal direction of gas conduit 212 for controlling the passage of natural gas through orifices 224. As a result, the gas velocity, and thereby the gas pressure, of the gas exiting front burner gun 210 can be accurately and readily controlled.

More particularly, orifice balls 236 are formed by spheres having a circumferential flat area 237 formed midway thereon with the circumferential flat areas 237 having a diameter less than that of inner opening sections 229 and being movable in the longitudinal direction of conduit 212 within inner opening sections 229.

The natural gas flows between the circumferential flat areas 237 and their respective inner opening sections 229 out from the burner gun assembly. Orifice balls 236, depending upon their positions within inlet opening sections 229, control the flow of natural gas out of the burner gun assembly. In the position shown in FIG. 5, orifice balls 236 are in sealing abutment with orifice restrictors 233 to prevent any natural gas from exiting the burner gun assembly. The orifice balls 236 can be retracted away from orifice restrictors 233, with the rate and amount of natural gas flow from the burner gun assembly depending upon the retracted distance.

The circumferential flat areas 237 are formed by machining the spheres and provide greater control of natural gas flow. In particular, the flat areas 237 provide a non-linear response curve for natural gas flow which is slower than the linear response curve achieved with the frusto-conical plugs 36 of FIG. 1B.

Figure 6:
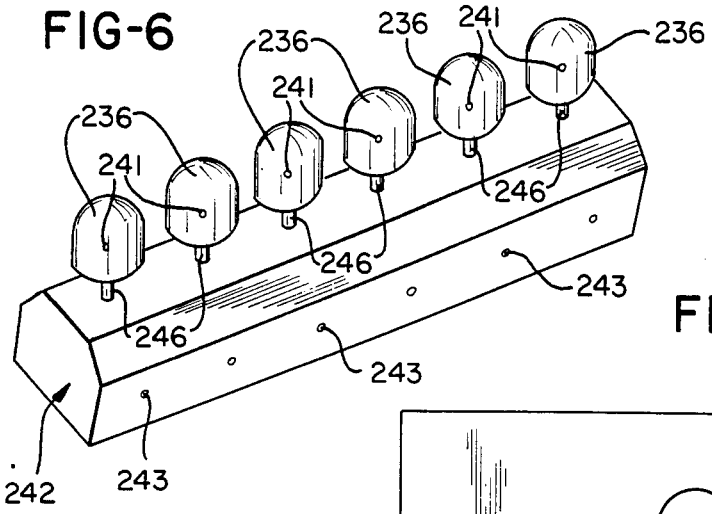
FIG. 6 is a perspective view of the retainer member and orifice balls connected thereto in the burner nozzle assembly of FIG. 5.
Figure 7:
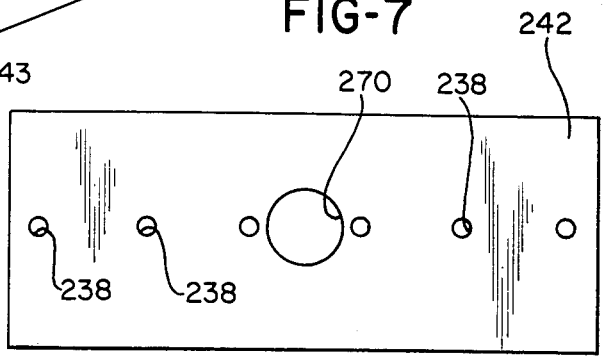
FIG. 7 is a bottom plan view of the retainer assembly of FIG. 6.

As shown in FIGS. 5 and 6, each orifice ball 236 is connected to a retainer 242 by means of a pin or stem 246. More particularly, a stem 246 is fixedly connected at one end thereof within a central aperture 239 in each ball 236 by means of a transverse pin 241 force fit through aligned apertures in stems 246 and orifice balls 236, as shown in FIG. 5. Each stem 246 is connected at its opposite end within a respective aperture 238 within retainer 242 by means of a second transverse pin 243 force fit through respective transverse apertures within stems 246 and retainer 242. With this arrangement, orifice balls 236 are linearly arranged in the manner shown in FIG. 8 or FIG. 9 for simultaneous movement within the respective orifices 224.

Retainer 242 is further provided with a central aperture 270 at its bottom having internal screw threads for receiving a piston rod bushing 271 secured at the distal end of a piston rod 272, which is identical to piston rod 72 of the embodiment of FIG. 1B, by means of a spring pin 276 and a set screw 277. As is apparent from FIG. 5, the distal end of bushing 271 contains external screw threads such that bushing 271 is screw-threadedly received within central aperture 270 of retainer 242.

The remainder of the burner assembly 210 according to the second embodiment of the present invention is substantially identical to the burner assembly 10 according to the first embodiment thereof. In this manner, piston rod 272 can be moved axially within conduit 212 to control retainer 242 and orifice balls 236 to move in the same axial direction with respect to orifices 224 to adjust the openings thereof. Accordingly, during operation of the burner gun according to the second embodiment of the present invention, the gas velocity can be accurately controlled to provide optimum heating characteristics of the burner flame envelope. In this manner, the pressure and velocity of the gas exiting from the burner gun can be accurately, easily and uniformly controlled.

The present invention envisions that the elements of the first and second embodiments may be interchanged. For example, orifice balls 236 can be used in place of orifice plugs 36 in the first embodiment.

Figure 10:
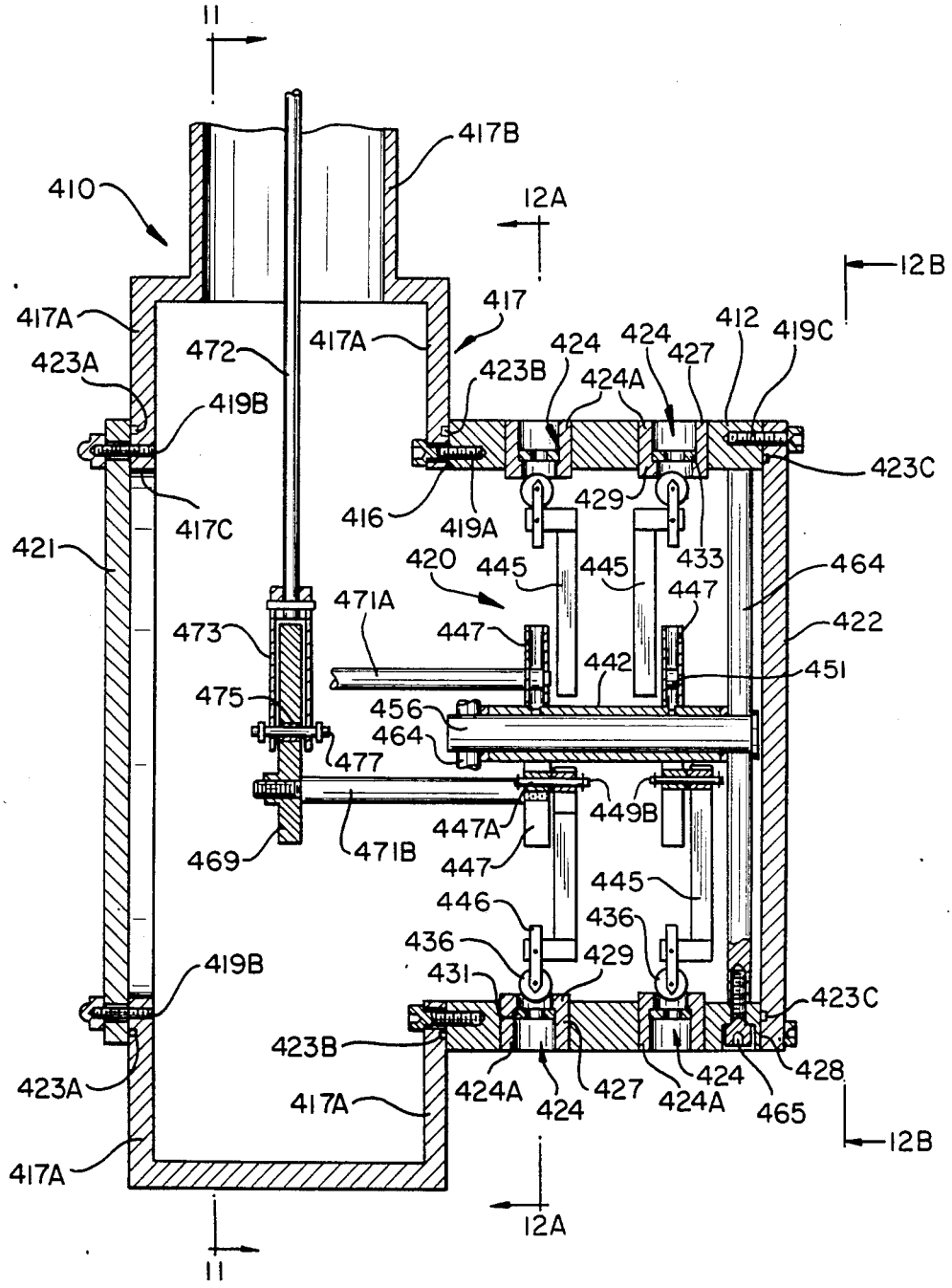
FIG. 10 is a cross-sectional view of a burner assembly for a radial duct burner according to another embodiment of the present invention.
Figure 11:
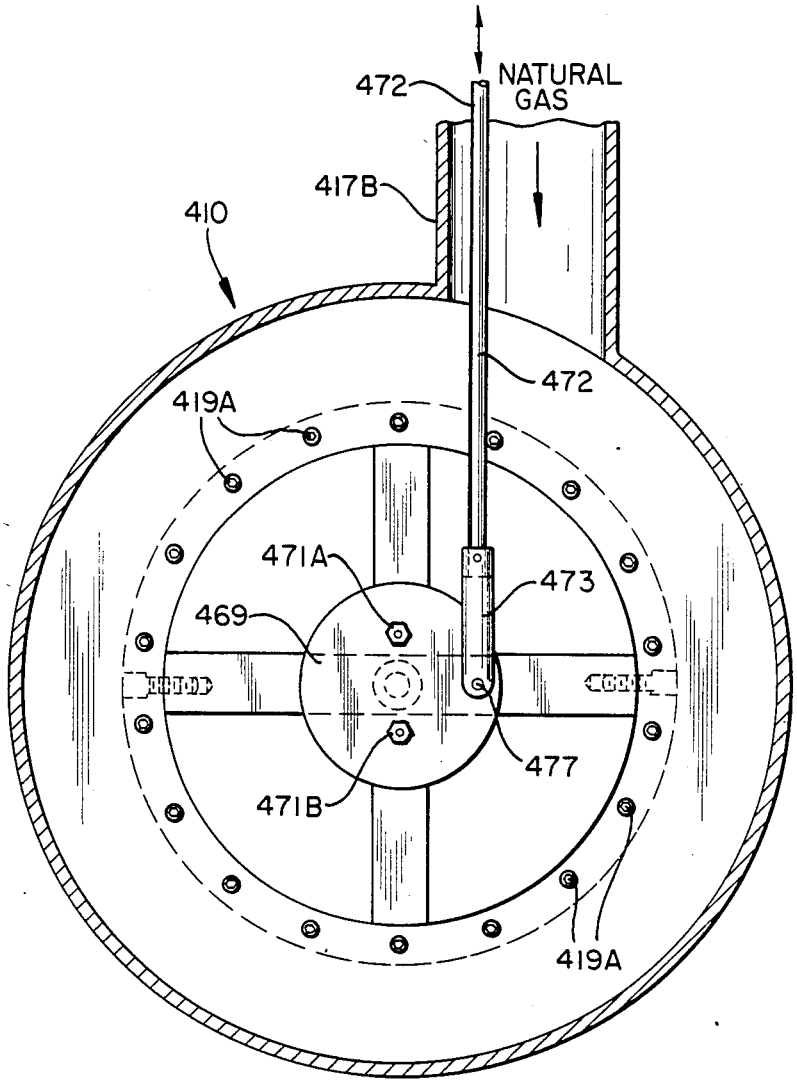
FIG. 11 is a cross-sectional view of the burner assembly of FIG. 10, taken along lines 11—11 thereof.
Figure 12:
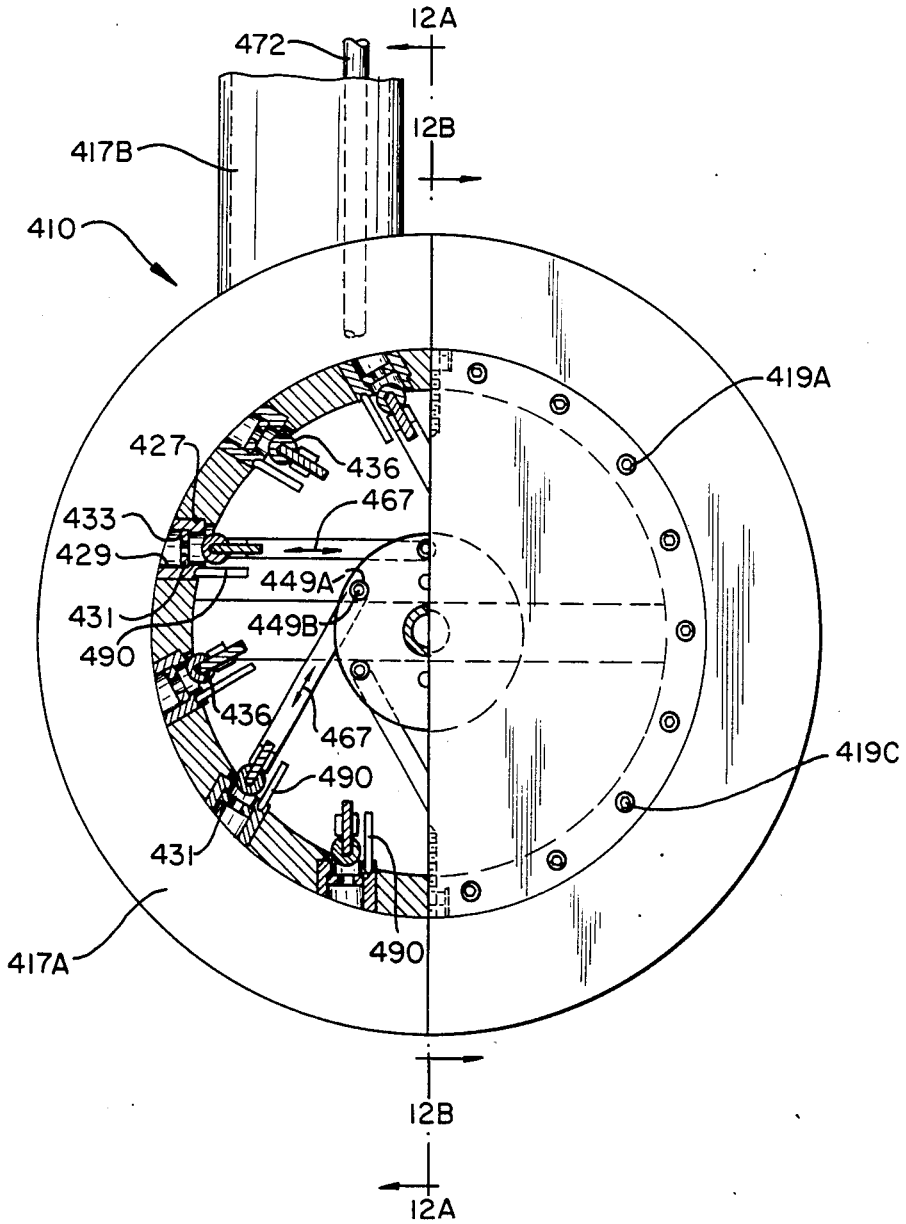
FIG. 12 is a cross-sectional view of the burner assembly of FIG. 10, the left-half taken along lines 12A—12A thereof and the right-half taken along lines 12B—12B thereof.

Referring now to FIGS. 10–12, a burner gun 410 according to another embodiment of the present invention for use with a radial duct burner includes a gas conduit 412 having an inlet 416 connected with an inlet supply duct 417 through which natural gas is supplied under pressure to gas conduit 412. Inlet supply duct 417 is generally comprised of a circumferential flanged section 417A secured by bolts 419A to opening 416 in conduit 412. Flanged section 417A is welded to a supply pipe 417B through which natural gas is supplied under pressure.

Since flanged section 417A is circumferential, the rear opening opposite the connection to conduit 412 is provided with a rear access cover 421 which is bolted to flanged section 417A by means of bolts 419B. By utilizing rear axis cover 421, access to the inside of burner gun 410 is permitted. In addition, a seal 423A is provided between flanged section 417A and rear access cover 421, and a similar seal 423B is provided between flanged section 417A and conduit 412 to provide a gas sealing arrangement.

The natural gas supplied at inlet supply duct 417B travels under pressure to gas conduit 412 and is emitted from the burner gun through a burner nozzle assembly 420 according to the present invention at the outlet side.

A front access plate 422 is secured by means of bolts 419C to the front circumferential edge 428 of conduit 412. Again, gas permeable seals 423C are provided between such connection. Such seals are preferably high temperature seals, as with all of seals 423A, B and C and may, for example, be type X750 made by Inconel.

Burner nozzle assembly 420 includes a plurality of rows of circumferentially arranged orifices 424 through which natural gas is emitted from the burner gun. The orifices 424 are preferably arranged in a plurality of axially spaced rows, two of such rows being shown in FIG. 10, with the circumferentially arranged orifices between different rows being arranged in line or offset with respect to each other, the orifices being shown in line in FIG. 10. It will be appreciated that orifices 424 are arranged for radial emission of natural gas from the burner gun, rather than axial emission as with the aforementioned embodiments.

Similar to the second embodiment of the present invention shown in FIG. 5, orifices 424 are defined by orifice sleeves 424A defining an outlet opening section 427 having a first diameter and an inlet opening section 429 having a second, smaller diameter. In this regard, each orifice 424 is formed with an outwardly directed shoulder 431 against which an orifice restrictor 433 is positioned. More particularly, each orifice restrictor 433 is comprised of a ring having an opening which determines the passage diameter through the respective orifice 424. It is to be appreciated that, with this arrangement, different orifice restrictors 433 can be positioned therein to vary the passage diameter of the orifices 424, depending upon the particular application.

In accordance with the third embodiment of the present invention, a plurality of orifice plugs in the form of orifice balls 436 corresponding in number to orifices 424 and each associated with a respective orifice 424 are simultaneously controlled for movement in the radial direction of gas conduit 412 for controlling the passage of natural gas through orifices 424. As a result, the gas velocity, and thereby the gas pressure of the gas exiting burner gun 410 can be accurately and readily controlled. Orifice balls 436 may be formed in a similar manner to orifice balls 236 of FIG. 5.

As shown in FIGS. 10 and 12, each orifice ball 236 is centrally connected to a pin or stem 446 which, in turn, is connected to radially arranged orifice ball connecting rod 445 which, as shown in FIG. 10, has an L-shaped configuration.

As shown in FIG. 10, each connecting rod 445 is connected at its inner radial end to a secondary control bell crank 447 by means of high temperature bearings 449A and high temperature pins 449B, such that connecting rods 445 are capable of pivoting at the connection of pins 449B with respect to its associated secondary control bell crank 447. It will be appreciated that each secondary control bell crank 447 has a circular disk-like configuration, and a secondary control bell crank 447 is associated with each row of orifices 424. Generally, as shown in FIG. 12, the free, radially inner ends of connecting rods 445 are pivotally connected at the outer radial portion of the respective secondary control bell crank 447.

Secondary control bell cranks 447 are arranged in spaced axial relation and connected to the outer surface of a retainer sleeve 442 by suitable bolts 451, retainer sleeve 442, which in turn, is rotatably mounted on a bell crank sleeve support shaft 456. The latter support shaft 456 is axially and centrally positioned within conduit 412 by means of bell crank and linkage support bars 464 at opposite ends thereof such that retainer sleeve 442 is prevented from moving in the axial direction, but is rotatably mounted on support shaft 456. The bell crank and linkage support bars 464, are, in turn, secured to the inner wall of conduit 412, for example, by respective bolts 465.

With the arrangement described so far, as retainer sleeve 442 rotates, orifice balls 436 move in the radial direction of conduit 412, as indicated by the arrows 467 in FIG. 12 and are guided in line with respect to orifices 424 by orifice ball guides 490 secured to inlet opening sections 429 and extending radially inward therefrom, as clearly shown in FIG. 12. In other words, the rotational movement of retainer sleeve 442 is translated to the reciprocable motion of orifice balls 436 with respect to orifices 424.

Referring to FIGS. 10 and 11, secondary control bell cranks 447 are rigidly connected to a primary control belt crank 469 by means of belt crank connecting rods 471A and 471B connected diametrically opposite each other on primary control belt crank 469 and secondary control belt cranks 447 and radially inward of the connection of orifice ball connecting rods 445 to secondary control bell cranks 447. Since primary control belt crank 469 also has a circular configuration, rotation of primary control bell crank 469 results in the same rotation of secondary control bell cranks 447 through connecting rods 471A and 471B.

As shown in FIGS. 10 and 11, an operating rod 472 extends through inlet supply pipe 417B and is pivotally connected at a position on the outer peripheral section of primary control bell crank 469 through an operating rod clevis 473 and a high temperature bearing 475 and high temperature pin 477.

In operation, recriprocable movement of operating rod 472 in the vertical direction of FIGS. 10 and 11 results in rotational movement of primary control bell crank 469 and thereby rotational movement of secondary control bell cranks 447. The rotation of secondary bell cranks 447, in turn, results in the simultaneous radial reciprocable motion of orifice balls 436 with respect to orifices 424 to vary the openings thereof so as to provide a constant velocity gas therethrough. Thus, the reciprocable motion of operating rod 472 is translated to rotational motion of contol bell cranks 447 and 469 which, in turn, is translated back to reciprocable motion of orifice balls 436.

Having described specific preferred embodiments of the invention with reference to the accompanying drawings, it is to be understood that the present invention is not limited to those precise embodiments and that various changes and modifications may be effected therein by one of ordinary skill in the art without departing from the spirit and scope of the present invention as defined by the appended claims.

What is claimed is:

1. A rotary kiln comprising:

a rotary tube for containing material to be burned, said rotary tube having a longitudinal axis, and said material tending to form a chordal incline at a substantially constant angle relative to a fixed reference frame as said tube containing said material is rotated in a given direction;

means for rotating said tube about its longitudinal axis; and a burner gun at a first end of said tube, said burner gun including:

(a) conduit means having an inlet, an outlet at said first end of said tube and a longitudinal axis;

(b) gas inlet means for supplying a gas to said inlet of said conduit means;

(c) gas outlet means for emitting said gas supplied to said conduit means, said gas outlet means including a plurality of orifices arranged in at least one linear row at said outlet of said conduit means, each orifice having a longitudinal axis substantially parallel to the longitudinal axis of said conduit means, each linear row being arranged substantially parallel to said incline;

(d) a plurality of orifice plug means, each axially adjustable with respect to a respective one of said orifices; and (e) control means for simultaneously adjusting said plurality of orifice plug means with respect to said plurality of orifices to vary the openings of said plurality of orifices so as to provide a constant gas velocity at the outlet of said conduit means.

2. A rotary kiln according to claim 1; in which said orifices are linearly arranged in a single row at said outlet of said conduit means.

3. A rotary kiln according to claim 1; in which said single row is substantially centrally arranged.

4. A rotary kiln according to claim 1; in which said orifices are linearly arranged in two, parallel rows at said outlet of said conduit means.

5. A rotary kiln according to claim 1; in which said two rows are substantially centrally arranged.

6. A rotary kiln according to claim 1; in which each of said orifice plug means has a spherical configuration with a circumferential flat section, and said orifice plug means has internal dimensions of a similar configuration and slightly larger dimensions than said circumferential flat section.

7. A rotary kiln according to claim 1; in which said control means includes means for arranging said orifice plug means in a predetermined relation to respective ones of said orifices and means for adjusting said means for arranging with respect to said plurality of orifices.

8. A rotary kiln according to claim 7; in which said gas outlet means includes outlet plate means in which said plurality of orifices are formed; and in which said means for arranging includes retainer means, said plurality of orifice plug means being secured to said retainer means in at least one linear row.

9. A rotary kiln according to claim 8; in which said means for adjusting includes piston rod means connected to said retainer means, and piston rod adjusting means for axially moving said piston rod means so as to control said axial movement of said plurality of orifice plug means with respect to said plurality of orifices.

10. A rotary kiln according to claim 9; in which said piston rod adjusting means is positioned externally of said burner gun for axially adjusting said plurality of orifice plug means with respect to said plurality of orifices during operation of said burner gun.

11. A rotary kiln according to claim 1; in which said gas outlet means includes outlet plate means in which said plurality of orifices are formed, each of said orifices including a first outer opening section having a first diameter and opening to the outlet of said conduit means and an inner opening section continuous with said outer opening section and having a diameter greater than said outer opening section so as to define an inwardly directed shoulder therebetween.

12. A rotary kiln according to claim 11; further comprising orifice restrictor means positioned within each orifice and in abutting relation with the respective shoulder thereof to define the diameter of the passageway through each said orifice.

13. A rotary kiln according to claim 1; in which said at least one linear row is arranged at approximately a 45° angle to the horizontal.

* * * * *